US007166561B2

(12) United States Patent
Allen

(10) Patent No.: US 7,166,561 B2
(45) Date of Patent: Jan. 23, 2007

(54) LUBRICANT-CARRYING SUBSTRATE FOR MAINTENANCE OF PAPER SHREDDERS

(75) Inventor: Mark S. Allen, Orem, UT (US)

(73) Assignee: Buttercup Legacy, LLC, Orem, UT (US)

( * ) Notice: Subject to any disclaimer, the term of this patent is extended or adjusted under 35 U.S.C. 154(b) by 286 days.

(21) Appl. No.: 10/925,470

(22) Filed: Aug. 25, 2004

(65) Prior Publication Data

US 2005/0095354 A1 May 5, 2005

Related U.S. Application Data

(60) Provisional application No. 60/514,154, filed on Oct. 23, 2003.

(51) Int. Cl.

| | |
|---|---|
| ***B65D 77/00*** | (2006.01) |
| ***B65D 77/06*** | (2006.01) |
| ***C10M 177/00*** | (2006.01) |
| ***F01M 11/00*** | (2006.01) |

(52) U.S. Cl. ..... 508/100; 508/110; 508/181; 184/109; 206/484; 241/2; 241/15; 427/11; 162/117; 162/135; 162/158

(58) Field of Classification Search ..... 508/101, 508/110, 181, 100; 15/104.93, 104.94; 162/135, 162/117, 158; 184/109; 241/2, 15, 22, 26, 241/100; 264/466; 427/11; 206/484
See application file for complete search history.

(56) References Cited

U.S. PATENT DOCUMENTS 3,258,210 A * 6/1966 Panning ..... 241/85
3,333,752 A * 8/1967 Vincens ..... 225/97
3,911,579 A * 10/1975 Lane et al. ..... 30/346.54
4,891,265 A * 1/1990 Samagalsky ..... 428/74
5,186,398 A * 2/1993 Vigneaux, Jr. ..... 241/33

(Continued)

FOREIGN PATENT DOCUMENTS

DE 3426979 * 1/1986

(Continued)

OTHER PUBLICATIONS

IDEAL Operating Instructions. MBM Corporation/IDEAL MBM Corporation. Mar. 2002. [retrieved on Jul. 25, 2006]. Retreived from the internet <http;//www.mbmcorp.com/pdfs/zo_0106.pdf>.*

(Continued)

*Primary Examiner*—Vasu Jagannathan
*Assistant Examiner*—Sandra Poulos
(74) *Attorney, Agent, or Firm*—Workman Nydegger

(57) ABSTRACT

Paper shredders are maintained using lubrication substrates that have been treated with or that carry a lubricant. The lubrication substrate is fed through the shredding mechanism of a paper shredder. Rather than requiring disassembly of the paper shredder, maintenance and lubrication can be performed by passing the lubrication substrate through the shredding mechanism. The lubrication substrates can take any of a variety of forms, such as a tissue that is encased in a cellophane or plastic envelope and is impregnated with oil. The lubrication substrates can instead have an array of small tubes that carry oil. In another example, the lubrication substrates can take for them of a bubble sheet that carries oil within the bubbles.

24 Claims, 6 Drawing Sheets

U.S. PATENT DOCUMENTS

| | | | | | |
|---|---|---|---|---|---|
| 5,250,353 | A | * | 10/1993 | Bartholomew et al. | 428/328 |
| 5,494,229 | A | * | 2/1996 | Rokos et al. | 241/15 |
| 2006/0169619 | A1 | * | 8/2006 | Wang | 206/484 |
| 2006/0243631 | | * | 11/2006 | Duke | 206/525 |

FOREIGN PATENT DOCUMENTS

| | | | | |
|---|---|---|---|---|
| DE | 29709492 | U | * | 8/1997 |
| GB | 2187238 | A | * | 9/1987 |
| JP | 08001023 | | * | 1/1996 |
| WO | WO 2006/036370 | | * | 4/2006 |

OTHER PUBLICATIONS

Lewis, Richard J., Sr. (2002). Hawley's Condensed Chemical Dictionary (14th Edition). John Wiley & Sons.*

Machine translation from <http://babelfish.altavista.com/> for DE 3426979.*

Translation for DE 29709492 U1.*

Translation for DE 3426979 A1.*

*Shredder Maintenance*. Secure Shredders. Printed Feb. 24, 2006, upon information and belief, avaliable at least as early as Aug. 24, 2000, <http://www.secureshredders.com/ss/partssopplies/oil/index/htm#oil>.

Quill Catalog, p. 1172, upon information and belief, available at least as early as Sep. 2000.

Lessons Learned Database, *Aerosol Lubricants Can Flash when Sprayed on Energized Shredders*, retrieved from http://www.eh.doe.gov/ll/lldb/detail.CFM?Lessons_IdentifierIntern=LANL-MATSC-CMPLX-2004-0002 on Oct. 24, 2006 (dated Jan. 28, 2004).

Safety Digest de Securite, *Valuable Lessons at Low Cost, retrieved from http://www.vcds.forces.gc.ca/dsafeg/pubs/digest/6-03/art06*_e.asp on Dec. 27, 2006 (Dated Jun. 2003).

* cited by examiner

LUBRICANT-CARRYING SUBSTRATE FOR MAINTENANCE OF PAPER SHREDDERS

RELATED APPLICATION

This application claims the benefit of U.S. Provisional Application Ser. No. 60/514,154, filed Oct. 23, 2003, which is incorporated herein by reference.

BACKGROUND OF THE INVENTION

1. The Field of the Invention

The present invention relates to the maintenance of paper shredders. More specifically, the present invention relates to methods for lubricating paper shredders using oil-carrying substrates that are fed through the shredding mechanism.

2. The Relevant Technology

In today's corporate world is it becoming increasingly popular to dispose of important business documents through paper shredding. The shredders come in various shapes and sizes, but they all have a similar goal. To shred important documents to protect privacy and business transactions and protect corporate know how.

Paper shredders require periodic maintenance and lubrication to effectively complete this task. Shredders are typically taken apart and oiled via a spray solution or liquid dispenser, which is problematic in several ways. Many owners and users of paper shredders fail to properly maintain and lubricate their machines because of the difficulty and inconvenience involved, which can lead to failure and the expense of purchasing a new shredder. Those who do maintain their shredders often must hire service personnel to complete this task. When owners or users of paper shredders personally dissemble and lubricate their shredders, they can be exposed to messy and potentially hazardous oils and inhalation of sprays. Thus, while paper shredders are common in many homes and businesses, they are often not maintained and serviced in a proper way.

BRIEF SUMMARY OF THE INVENTION

The devices and methods disclosed herein relate to the maintenance of paper shredders using a substrate that is treated or carries a lubricant and can be fed through the shredding mechanism of a paper shredder. The use of lubrication sheets greatly simplifies the process of maintaining and lubricating paper shredders. Rather than requiring disassembly of the paper shredder, maintenance and lubrication can be performed by passing a lubrication sheet through the shredding mechanism. This process requires no specialized mechanical or maintenance skill other than knowledge of how to operate a paper shredder. Moreover, lubrication sheets are much cleaner than the lubricants or sprays that have been conventionally used after a paper shredder has been disassembled.

The lubrication sheets can take any of a variety of forms. For example, the lubrication sheet can be an oil-impregnated tissue that is encased in a cellophane or plastic envelope. Alternately, the lubrication sheet can have an array of small diameter tubes filled with oil. In another implementation of the invention, the lubrication substrate is formed from a bubble sheet containing oil in the bubbles.

In any of these embodiments, the lubrication substrate can be passed through a paper shredder in a manner similar to inserting an ordinary paper into the shredder. The blades of the paper shredder engage and disintegrate the lubrication substrate, which releases the lubricant, thereby lubricating the blades. This technique for lubricating the paper shredder blades can be performed without dissembling the paper shredder.

In general, the lubrication sheets can be any structure that carries a lubricant and can be passed through the shredding mechanism of a paper shredder to deliver the lubricant to the blades of the paper shredder. This technique for lubricating and maintaining paper shredders significantly reduces the cost and effort that has been required in conventional lubrication methods.

These and other objects and features of the present invention will become more fully apparent from the following description and appended claims, or may be learned by practicing the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The devices and methods disclosed herein relate to the maintenance of paper shredders using a substrate that is treated or carries a lubricant and can be fed through the shredding mechanism of a paper shredder. The devices that are used in this manner are referred to herein as "lubrication sheet," and various examples thereof are disclosed in this document. The use of lubrication sheets greatly simplifies the process of maintaining and lubricating paper shredders. Rather than requiring disassembly of the paper shredder, maintenance and lubrication can be performed by passing a lubrication sheet through the shredding mechanism. This process requires no specialized mechanical or maintenance skill other than knowledge of how to operate a paper shredder. Moreover, lubrication sheets are much cleaner than the lubricants or sprays that have been conventionally used after a paper shredder has been disassembled.

Figure 1:
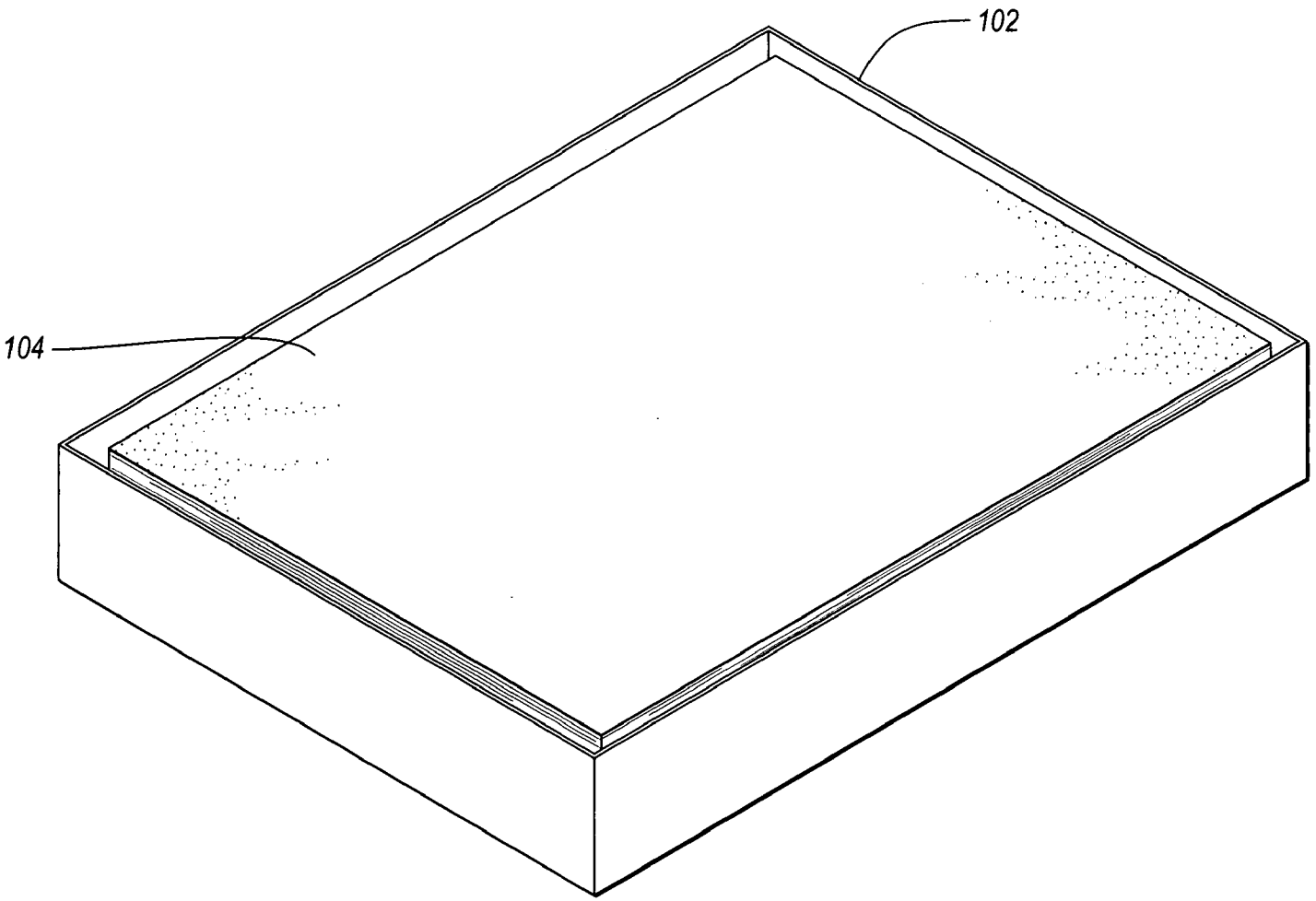
FIG. 1 illustrates a group of corrugated tissue papers that are impregnated with oil for lubricating a paper shredder.
Figure 2:
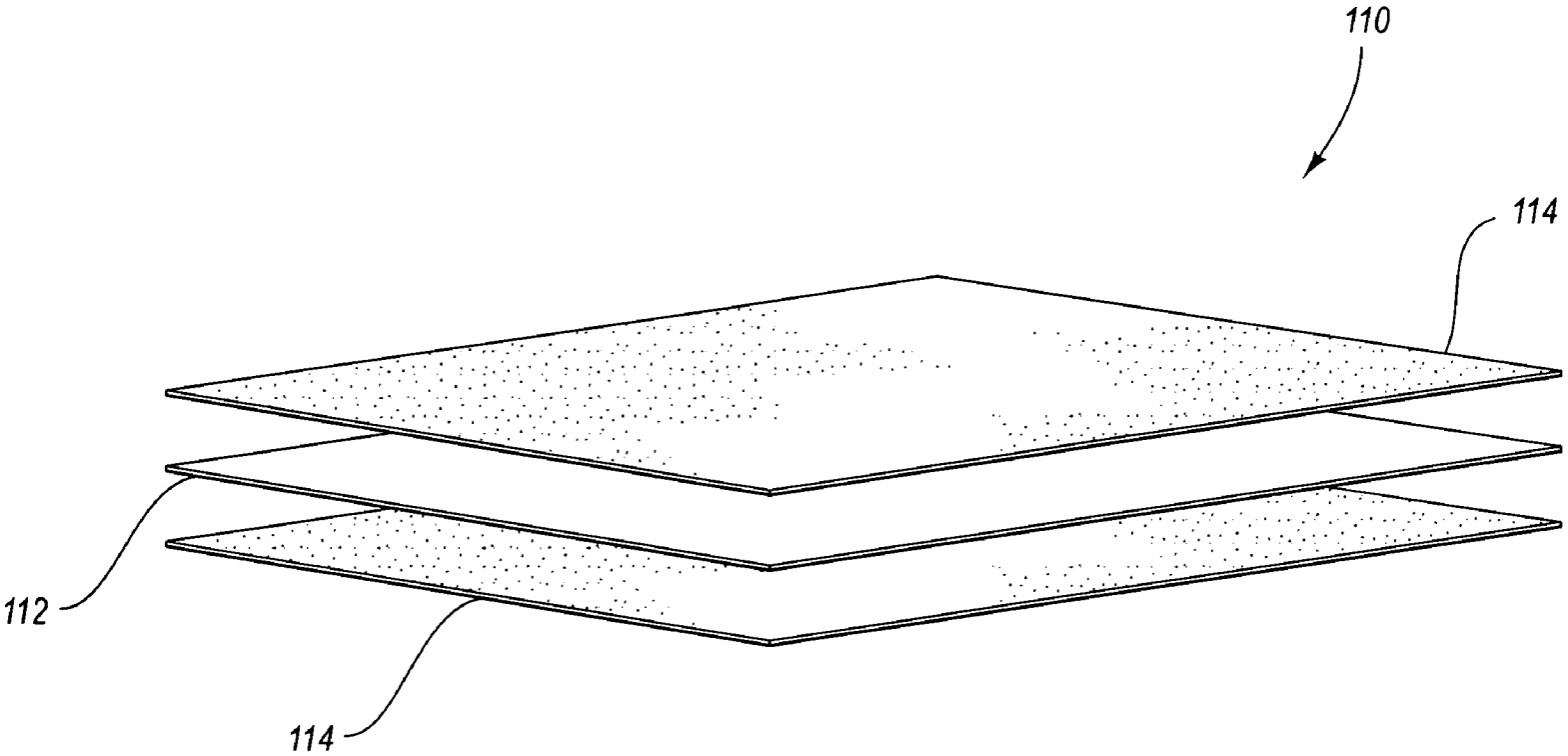
FIG. 2 illustrates a sealed plastic envelope that contains an oil-impregnated layer for lubricating a paper shredder.

FIGS. 1–6 illustrate various embodiments of the lubrication sheets and the methods for maintaining and lubricating paper shredders using the lubrication substrates. FIGS. 1 and 2 illustrate an embodiment of a lubrication sheet that includes a shell that encases substrate that is treated with oil or another lubricant. The shell can be formed from cellophane or from a polymeric, or plastic, material, in which case, the shell is substantially non-penetrable and seals the encased substrate and lubricant, while protecting the user from exposure to any oily substance.

The shell of FIGS. 1 and 2 and the other shells disclosed herein include one or two shell layers positioned, respectively, on one or either side of the lubrication sheet. The shell layers can be impermeable to the lubricant or, in other embodiments, can be formed from paper or another material that is not necessarily impermeable to the lubricant. For example, in embodiments, such as those of FIGS. 3–6, in which the lubricant is encased by the structure of the lubricant substrate, the user can be protected from exposure to the lubricant without requiring an impermeable shell layer. In general, the shell layers can provide mechanical stiffness and rigidity to the lubrication sheets, which can be useful in facilitating the act of passing the lubrication sheet through the shredding mechanism.

FIG. 1 illustrates a cellophane enclosure 102 that encases a stack of light corrugated tissue papers 104 that are encased with a lubricant. Prior to use, the tissue papers 104 can be stored in the cellophane enclosure 102. At the time that one of the tissue papers 104 is to be applied to the shredding mechanism of a paper shredder, the tissue paper is removed from the cellophane enclosure 102 and is fed into the paper shredder. FIG. 1 is an example of a stack of individual substrates that are stored in a protective enclosure prior to use.

FIG. 2 illustrates an exploded view of a sheet 110 having a single substrate 112 that is sealed in an envelope 114 that is formed from a plastic or polymeric material or another oil-impervious material that prevents the lubricant from leaving the substrate prior to shredding. The substrates 104 of FIG. 1 and the substrates 112 of FIG. 2 are available in various thickness and sizes (e.g., $1/16^{th}$ inch, $1/8^{th}$ inch, $1/4^{th}$ inch). The substrate can be paper, Teflon® or another fluoropolymer resin, or another suitable substrate that can carry the lubricant and be passed through and shredded by the shredding mechanism of the paper shredder. The person performing maintenance places the lubrication sheet into the paper shredder. As the shredder pulls in and shreds the plastic casing, the lubricant coats the blades of the shredding mechanism and effectively oils the shredder without the need to dismantle the device. Moreover, certain substrates, such as fluoropolymer resins, can also operate as lubricants and partially coat the blades of the shredding mechanism when the lubricant sheet is shredded. Packages of multiple lubrication sheets can be sold to owners of paper shredders, thereby enabling paper shredders to be lubricated immediately whenever the need arises.

Figure 3:
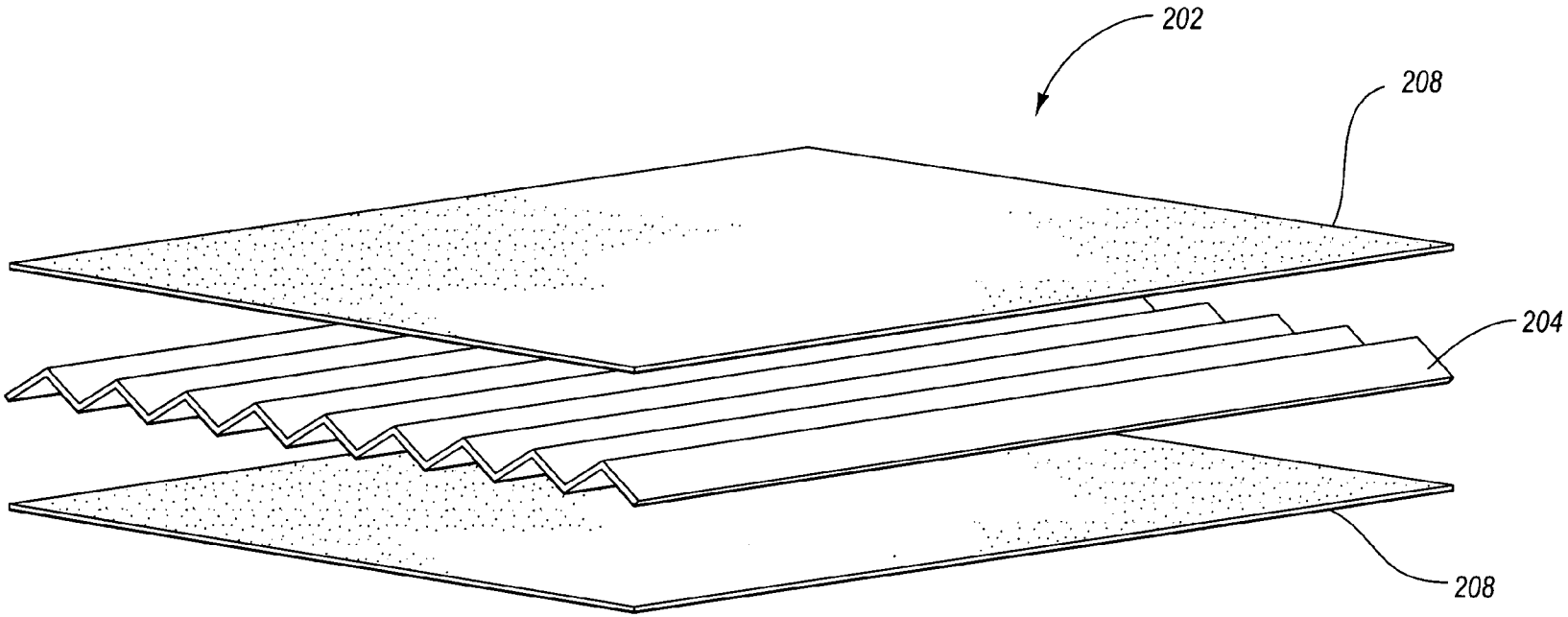
FIGS. 3 and 4 depict a lubrication substrate with an array of small diameter tubes filled with oil for lubricating a paper shredder.
Figure 4:
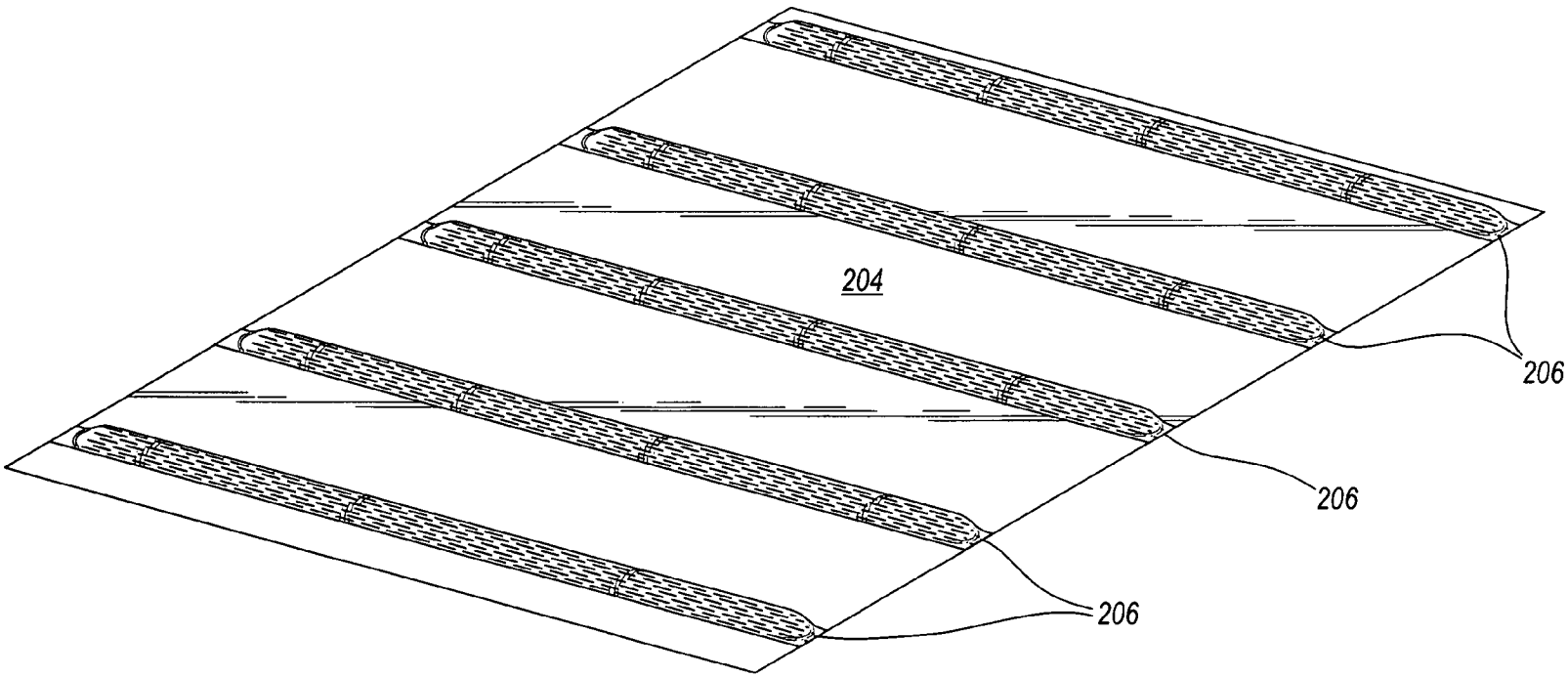

FIGS. 3 and 4 illustrate an alternate embodiment that is similar in many aspects to the lubrication sheets of FIGS. 1 and 2. The lubrication sheet 202 of FIGS. 3 and 4 has a lubrication substrate 204 with an array of small diameter tubes 206 filled with a lubricant. As shown in the exploded view of FIG. 3, the lubrication substrate 204 can be encased in an envelope 208. The lubrication substrate 204 carries the small diameter tubes 206 rather than being directly impregnated with oil. The tubes 206 can take a variety of forms. For example, the tubes 206 can be integrally formed on substrate 204 or can be formed separately and attached thereto during the process of manufacturing the lubrication sheets 202. The tubes 206 can be separate structures or can be formed from a single tubular structure that is extends back and forth over the substrate 204. The methods for using the lubrication substrates 204 of FIGS. 3 and 4 are essentially the same as those described elsewhere herein. However, the tubes 206 further isolate the lubricant from the user and the environment prior to the substrate 204 being passed through the paper shredder.

Figure 5:
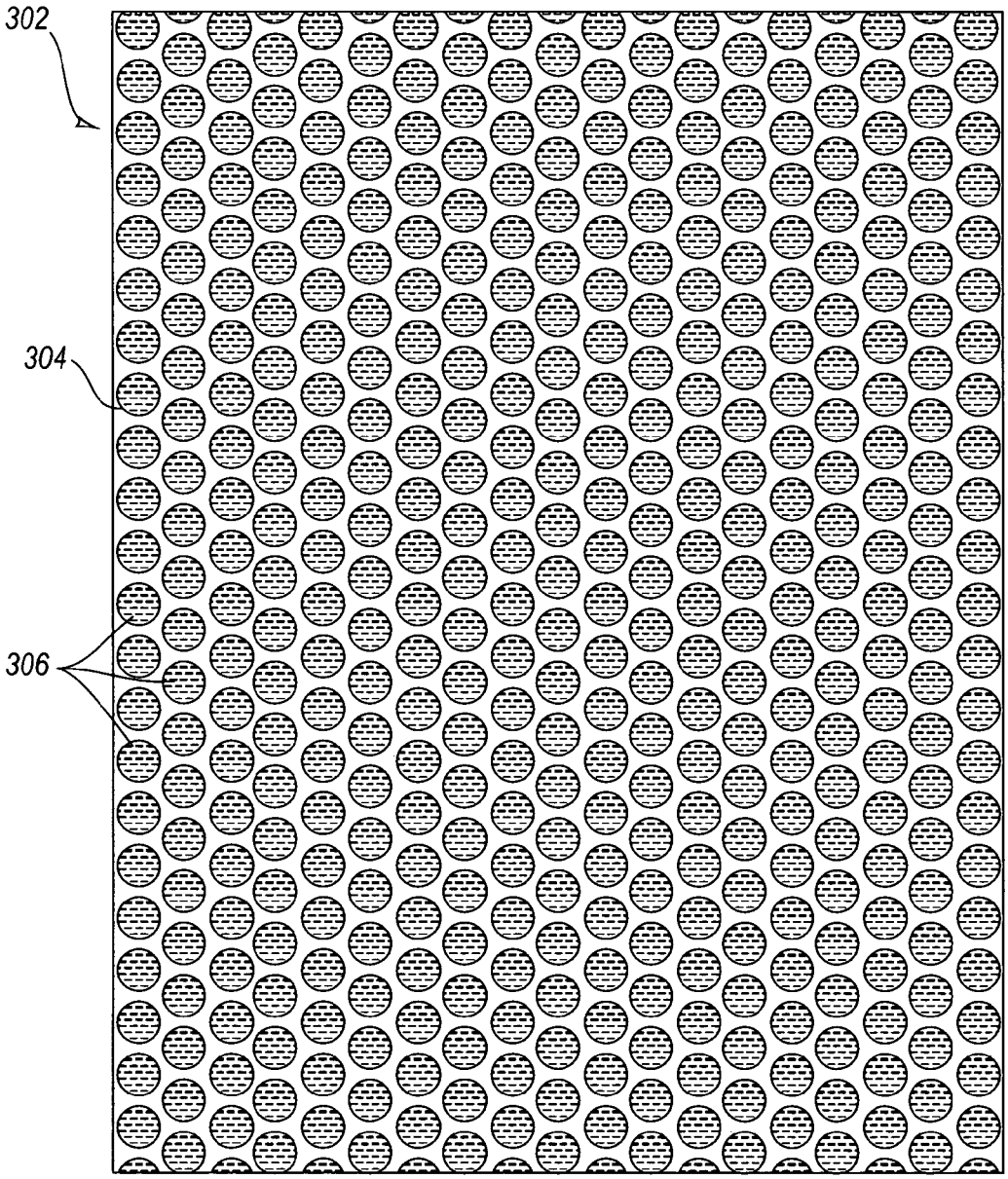
FIGS. 5 and 6 illustrate a lubrication substrate formed from a bubble sheet that contains oil for lubricating a paper shredder.
Figure 6:
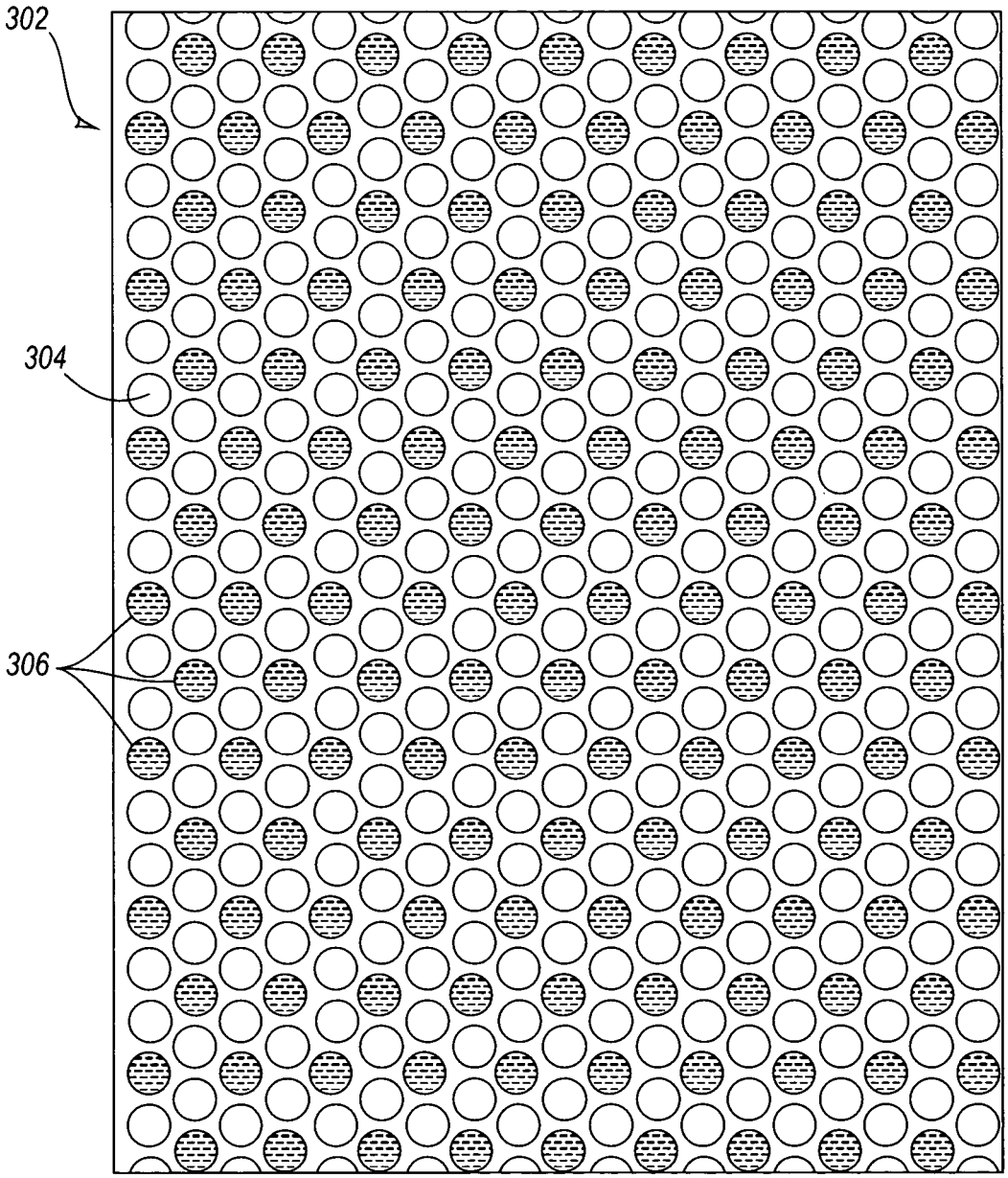

FIGS. 5 and 6 illustrate another embodiment of the lubrication sheets of the invention. This embodiment includes a lubrication substrate 302 in the form of a bubble sheet 304 having a structure similar to conventional bubble wraps that are used for packaging. The bubble sheet 304 is adapted for use in the maintenance and lubrication of paper shredders by filling some or all of the individual bubbles 306 with the lubricant. The bubble sheet 304 effectively encases the lubricant until the lubrication sheet 302 is passed through the shredding mechanism. The lubrication sheet 302 can include only the bubble sheet 304 and the associated lubricant or can instead also include other layers on one or either side of the bubble sheet layer, such as paper, tissue, cellophane, plastic, a fluoropolymer resin, etc.

In general, the lubrication sheets can be any structure that carries a lubricant and can be passed through the shredding mechanism of a paper shredder to deliver the lubricant to the blades of the paper shredder. This technique for lubricating and maintaining paper shredders significantly reduces the cost and effort that has been required in conventional lubrication methods. The invention extends to both the lubrication and other substrates described herein and to the methods of using the substrates as they are passed through the shredding mechanism of a paper shredder.

While the foregoing discussion has been directed generally to the use of substrates for carrying and releasing a lubricant to the blades of a paper shredder, the principles of the invention can also be applied to the delivery of other substances into a paper shredder. For example, the lubrication sheets disclosed herein can be adapted to carry a substance that facilitates the destruction or decomposition of paper (hereinafter "decomposition agent"). The decomposition agent can be carried by the substrates either with or without the lubricant. In addition, the decomposition agent can be carried by substrates having the structures illustrated and otherwise described herein, or that have other structures that will be understood by those of skill in the art upon learning of the inventive concepts disclosed herein.

In one embodiment, the decomposition agent includes microbes that facilitate the decomposition of paper. The microbes can be those that have conventionally been used at toxic waste sites or can be other microbes suitable for enhancing the decomposition of paper.

The decomposition agents and methods for delivering them to paper in a paper shredder as described herein are useful to further prevent unauthorized individuals from gaining access to information written on papers that have been shredded. Thus, the use of the decomposition agents in combination with the physical shredding of paper in a paper shredder can effectively prevent unauthorized individuals from obtaining any useful information from the paper that has been processed by the shredder and the decomposition agent.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A lubrication sheet for lubricating a paper shredder, comprising:

a lubrication substrate that is configured to be passed through a shredding mechanism of the paper shredder;

a lubricant carried by the lubrication substrate; and one or more shell layers adjacent to the lubrication substrate, wherein the one or more shell layers provide mechanical stiffness and rigidity to the lubrication sheet.

2. The lubrication sheet of claim 1, wherein the lubrication substrate comprises a substrate that is impregnated with the lubricant.

3. The lubrication sheet of claim 2, wherein the lubrication substrate is formed from a fluoropolymer resin.

4. The lubrication sheet of claim 1, wherein the one or more shell layers comprise two shell layers, one on either side of the lubrication substrate, the two shell layers forming a shell that is substantially impermeable to the lubricant.

5. The lubrication sheet of claim 1, wherein the one or more shell layers are formed from cellophane.

6. The lubrication sheet of claim 1, wherein the one or more shell layers are formed from a polymeric material.

7. The lubrication sheet of claim 1, further comprising a decomposition agent that is carried by the lubrication substrate and is capable of facilitating the decomposition of paper that has been shredded by the paper shredder.

8. A lubrication sheet for lubricating a paper shredder, comprising:

a lubrication substrate that is configured to be passed through a shredding mechanism of the paper shredder; and a lubricant carried by the lubrication substrate wherein the lubrication substrate comprises corrugated tissue paper.

9. The lubrication sheet of claim 8, wherein the lubrication substrate comprises a substrate that is impregnated with the lubricant.

10. The lubrication sheet of claim 9, wherein the lubrication sheet further comprises one or more shell layers adjacent to the lubrication substrate.

11. The lubrication sheet of claim 8, wherein the lubrication substrate further carries a decomposition agent that is released when the lubrication sheet is passed through the shredding mechanism, such that the decomposition agent facilitates the decomposition of paper that has been shredded by the paper shredder.

12. The lubrication sheet of claim 8, further comprising one or more shell layers adjacent to the corrugated tissue paper.

13. A lubrication sheet for lubricating a paper shredder, comprising:

a lubrication substrate that is configured to be passed through a shredding mechanism of the paper shredder; and a lubricant carried by the lubrication substrate, wherein the lubrication substrate comprises an array of tubes containing the lubricant.

14. The lubrication sheet of claim 13, further comprising: one or more shell layers adjacent to the lubrication substrate.

15. The lubrication sheet of claim 14, wherein the one or more shell layers provide mechanical stiffness and rigidity to the lubrication substrate.

16. The lubrication sheet of claim 13, wherein the tubes of the lubrication substrate further contain a decomposition agent.

17. A lubrication sheet for lubricating a paper shredder, comprising:

a lubrication substrate that is configured to be passed through a shredding mechanism of the paper shredder; and a lubricant carried by the lubrication substrate, wherein the lubrication substrate comprises a bubble sheet having a two dimensional array of bubbles that contain the lubricant.

18. The lubrication sheet of claim 17, wherein the bubbles of the lubrication substrate further contain a decomposition agent.

19. The lubrication sheet of claim 17, further comprising: one or more shell layers adjacent to the lubrication substrate.

20. The lubrication sheet of claim 19, wherein the one or more shell layers comprise two shell layers, one on either side of the lubrication substrate.

21. A method for lubricating a shredding mechanism of a paper shredder, comprising:

obtaining a lubrication sheet that includes:

a lubrication substrate that is configured to be passed through the shredding mechanism of the paper shredder, wherein the lubrication substrate comprises an array of tubes containing the lubricant; and a lubricant carried by the lubrication substrate; and passing the lubrication sheet through the shredding mechanism of the paper shredder such that the lubrication sheet is shredded and the lubricant is applied to the shredding mechanism.

22. A structure for delivering a decomposition agent to paper that has been shredded by a paper shredder, comprising:

a substrate that is configured to be passed through a shredding mechanism of the paper shredder; and a decomposition agent that is carried by the substrate and is capable of facilitating the decomposition of paper that has been shredded by the paper shredder after the substrate has been passed through the shredding mechanism.

23. The structure of claim 22, wherein the substrate further carries a lubricant, such that the lubricant is applied to the shredding mechanism when the structure is passed through the shredding mechanism.

24. The structure of claim 22, wherein the decomposition agent comprises a microbial agent.

* * * * *

US007166561C1

(12) EX PARTE REEXAMINATION CERTIFICATE (9139th)

United States Patent
Allen

(10) Number: US 7,166,561 C1
(45) Certificate Issued: Jul. 17, 2012

(54) LUBRICANT-CARRYING SUBSTRATE FOR MAINTENANCE OF PAPER SHREDDERS

(75) Inventor: Mark S. Allen, Orem, UT (US)

(73) Assignee: Buttercup Legacy, LLC, Orem, UT (US)

Reexamination Request:
No. 90/008,820, Aug. 27, 2007

Reexamination Certificate for:

| | |
|---|---|
| Patent No.: | **7,166,561** |
| Issued: | **Jan. 23, 2007** |
| Appl. No.: | **10/925,470** |
| Filed: | **Aug. 25, 2004** |

Related U.S. Application Data

(60) Provisional application No. 60/514,154, filed on Oct. 23, 2003.

(51) Int. Cl.

| | |
|---|---|
| ***B65D 77/00*** | (2006.01) |
| ***B02C 18/00*** | (2006.01) |
| ***B05D 1/00*** | (2006.01) |
| ***B26D 7/08*** | (2006.01) |
| ***C10M 177/00*** | (2006.01) |

(52) U.S. Cl. ..... 508/100; 162/117; 162/135; 162/158; 184/109; 206/484; 241/2; 241/15; 427/11; 508/110; 508/181

(58) Field of Classification Search ..... None
See application file for complete search history.

(56) References Cited

To view the complete listing of prior art documents cited during the proceeding for Reexamination Control Number 90/008,820, please refer to the USPTO's public Patent Application Information Retrieval (PAIR) system under the Display References tab.

*Primary Examiner*—Jerry D. Johnson

(57) ABSTRACT

Paper shredders are maintained using lubrication substrates that have been treated with or that carry a lubricant. The lubrication substrate is fed through the shredding mechanism of a paper shredder. Rather than requiring disassembly of the paper shredder, maintenance and lubrication can be performed by passing the lubrication substrate through the shredding mechanism. The lubrication substrates can take any of a variety of forms, such as a tissue that is encased in a cellophane or plastic envelope and is impregnated with oil. The lubrication substrates can instead have an array of small tubes that carry oil. In another example, the lubrication substrates can take for them of a bubble sheet that carries oil within the bubbles.

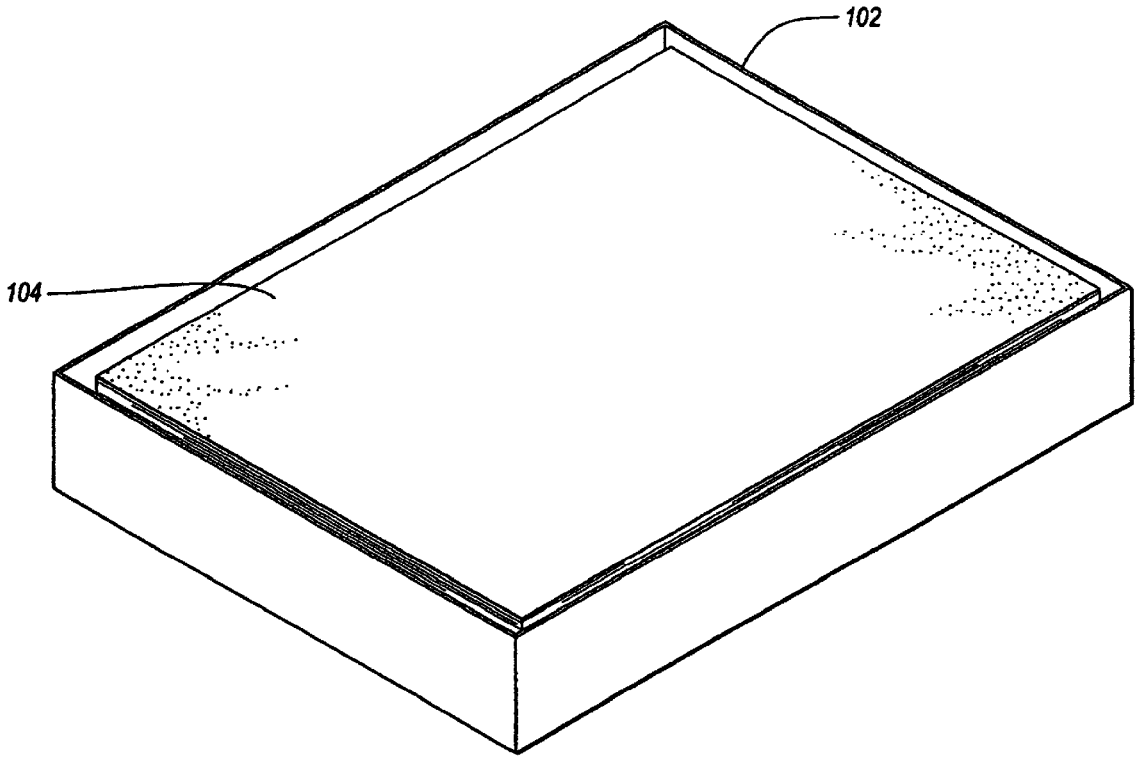

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1, 2 and 4-6 are cancelled.

Claims 3 and 7-24 were not reexamined.

* * * * *